US005171032A

United States Patent [19]

Dettmer

[11] Patent Number: 5,171,032

[45] Date of Patent: Dec. 15, 1992

[54] BRAKE DEVICE FOR IN-LINE SKATES

[76] Inventor: William Dettmer, 160 Tulare St., Brisbane, Calif. 94005-1745

[21] Appl. No.: 788,219

[22] Filed: Nov. 5, 1991

[51] Int. Cl.[5] ..... A63C 17/14

[52] U.S. Cl. ..... 280/11.2; 280/11.22; 188/74

[58] Field of Search ..... 280/11.2, 11.22, 843, 280/11.27, 11.19, 87.041; 188/70 R, 71.1, 72.1, 72.3, 72.7, 2 D, 74

[56] References Cited

U.S. PATENT DOCUMENTS

| | | | |
|---|---|---|---|
| 1,371,623 | 3/1921 | Ickenroth | 280/11.2 |
| 1,801,205 | 4/1931 | Mirick | 280/11.2 |
| 4,076,266 | 2/1978 | Krausz | 280/11.2 |
| 4,300,781 | 11/1981 | Riggs | 280/11.2 |
| 4,943,075 | 7/1990 | Gates | 280/11.2 |

*Primary Examiner*—Richard M. Camby

[57] ABSTRACT

A skate brake for use on in-line roller skates of the type typically having 3, 4, or 5 wheels in linear alignment. The brake has a channel shaped sheet metal frame that fits around the wheel carriage of the skates. The frame holds a number of brake pads in the spaces between the wheels of the skate. An actuator cable connects the frame to a hand held control lever. When the lever is operated, it causes the frame to slide forward, bringing the brake pads into frictional contact with the wheels to cause a braking action. The brake is simple and lightweight, and it does not interfere with the maneuverability of the skates. The brake is easily adapted for retrofitting onto preexisting in-line skates. Also disclosed, is a method for attaching the hand held control levers of a pair of skates together so that the brake mechanisms can be simultaneously operated with one hand.

16 Claims, 2 Drawing Sheets

BRAKE DEVICE FOR IN-LINE SKATES

BACKGROUND—FIELD OF INVENTION

This invention relates to in-line roller skates, specifically to the application of braking force upon the wheels of in-line skates.

BACKGROUND—DESCRIPTION OF PRIOR ART

Recently in-line roller skates have become popular. In-line roller skates, or in-line skates, have multiple wheels mounted in-line along a carriage from the rear to the front of the users foot. The wheels are typically so placed and shaped as to allow tilting of the in-line skate to as much as 30 degrees from vertical while not reducing the wheel ground contact area. Such a skate behaves similarly to ice skates in many ways except for stopping, as in side slipping. Side slipping, where an ice skate is pointed perpendicular to the skates' velocity, would wear flat spots on in-line skate wheels. Presently in-line skates sold are equipped with ground contact friction devices located on the rear of the skate.

For many years roller skates and skate products have been equipped with braking mechanisms usually consisting of a friction material which can be made to contact the ground, or mechanical devices that can act upon the wheels of the skates. Generally friction pads affixed to a skate require a significant change of position of the skate to bring the friction pad into contact with the ground to effect braking. Friction pad wear causes a progressive change of the required position of the skate to effect braking. The friction pads must be periodically replaced, necessitating the use of tools. The friction pad brake is also difficult to use and often results in loss of balance of the skater when used.

Inventors of skating devices have provided mechanical brakes, both foot and hand actuated. In 1965 Sven Osxar Wilje in his U.S. Pat. No. 3,884,486 described a brake device for ski skates in which helical compression springs provided between the wheels and the frame prevent braking until the foot is moved sideways against the spring action, to move braking components together. Said sideways movement of the foot would cause instability in braking in-line skates. This method of braking force also could not be distributed to multiple wheels of the in-line skate.

Although hand actuated brakes have been proposed for skate like devices, none have been applicable In-line skates. U.S. Pat. No. 4,943,075 to Gates (1990) disclosed a hand actuated bicycle type caliper braking unit which applied braking force to the rear wheel of his skating device by friction pads. This skate braking device failed to distribute braking force to many wheels. Gates's method could not be applied to in-line skates because of space constraints and the small size of in-line skate wheels. Gates also did not provide a means of actuating both skating devices with one hand when even braking of both skates is required.

Complex solutions have been proposed requiring many moving parts. Scheck in 1978 U.S. Pat. No. 4,108,451 proposed a bicycle brake lever to actuate multiple braking means on a skate. While possibly effective as an in-line skate brake, this method required the use of many parts which introduce numerous complications to the manufacture and use of this system. It is clear that a new combination of embodiments is necessary to provide braking for the in-line skate.

OBJECTS AND ADVANTAGES

Several objects and advantages of the present invention are:

to provide a brake that is light and fits in a confined volume so as not to protrude from the side of the skate to provide a brake that consists of one moving piece containing the mounting for actuator cable, brake pads, and retraction band to provide a brake that distributes the load of braking over a large area of the in-line skate wheel carriage thus reducing the need of point reinforcements to provide a brake which allows the skater to brake without the need to adjust the position of the feet.

to provide a brake that distributes braking force to many wheels to provide a brake that can be built in during production or added on to existing in-line skates to provide hand control devices that may be held and actuated separately or by one hand to provide a brake which allows the skater to replace worn brake pads without tools Further objects and advantages are to provide a brake for in-line skates of two or more wheels, for example four or five, that require no additional moving parts or complications for additional wheels. Still further objects and advantages will become apparent from a consideration of the ensuing description and drawings.

DRAWING FIGURES

REFERENCE NUMERALS IN DRAWINGS

| | |
|---|---|
| 10 brake assembly | 11 frame |
| 12 flange | 13 slot |
| 14 cable locator | 15 thrust tab |
| 16 band retaining tab | 17 brake pad positioning tab large |
| 18 brake pad seat | 19 brake pad positioning tab small |
| 20 cable attachment rack | |
| 30 retraction band | 34 retraction band anchor |
| 40 brake pad | 42 brake pad adhesive |
| 50 retaining screw | 60 actuator cable |
| 62 cable housing | 64 cable end hook |
| 80 hand control | |
| 82 lever | 84 lever base |
| 86 handle | 88 hook and loop fastener |
| 90 wheel carriage | 92 foot retaining device |
| 94 forward axle retaining device | 96 rear axle retaining device |
| 98 wheel | |

DESCRIPTION—FIGS. 1 TO 5

Figure 1:
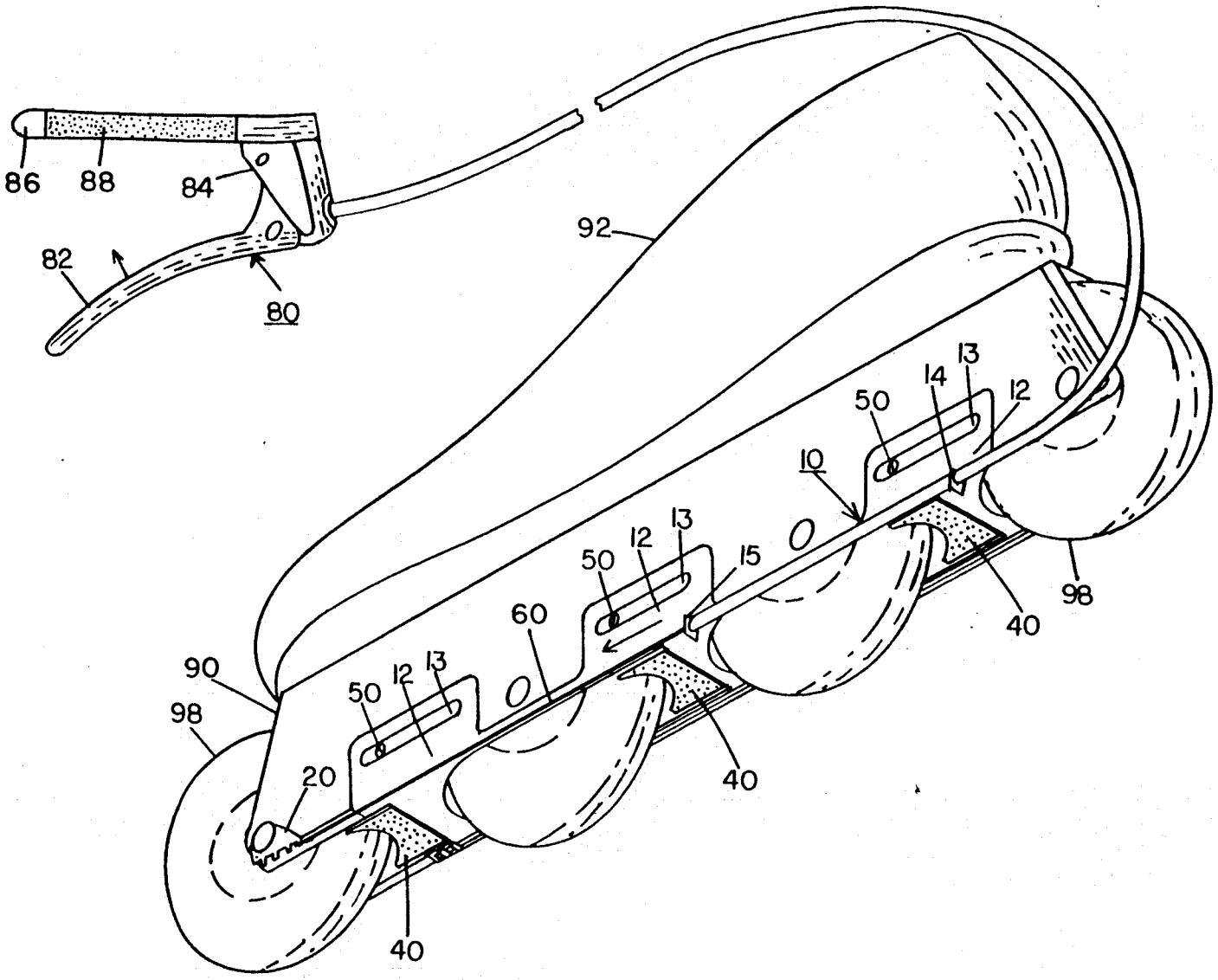
FIG. 1 is a perspective view from the lower right of an in-line brake assembly, wheel carriage, foot retaining device, and hand control.
Figure 2:
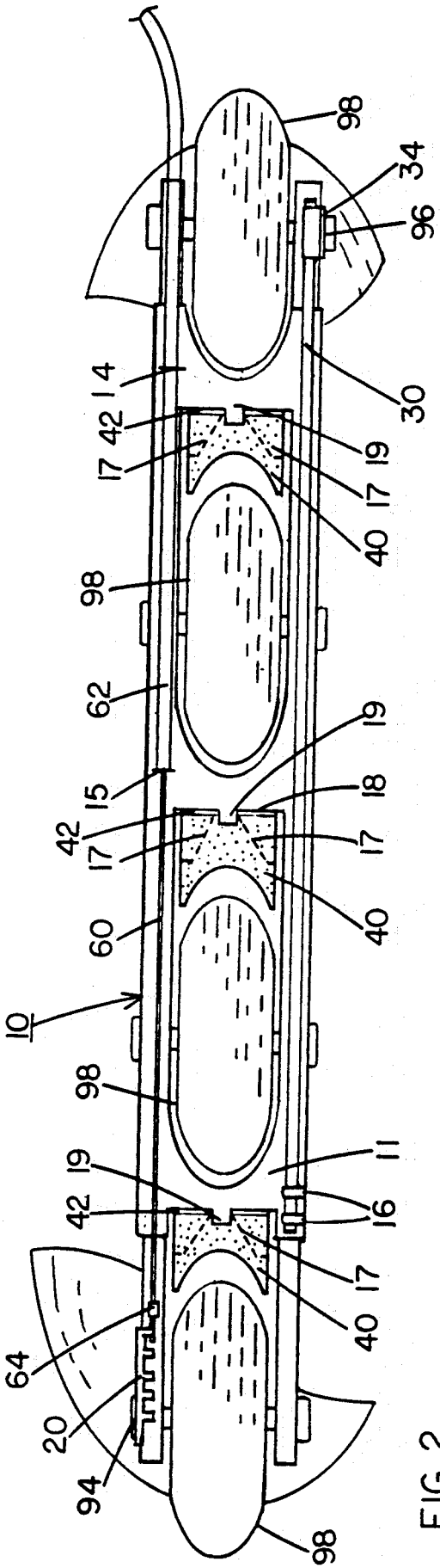
FIG. 2 is a bottom view of an in-line skate brake assembly mounted onto a four wheel in-line skate wheel carriage.

A typical embodiment of the present invention is illustrated in FIG. 1 (perspective) and FIG. 2 (bottom view). Shown is the brake assembly 10 consisting of frame 11 of a rigid material which may be deformed or molded to provide for the attachment of actuator cable housing 62, retractive band 30, and brake pads 40. As shown the frame does not extend to the rear most wheel because in most currently produced in-line skates the wheel carriage, and thus support of the frame, does not continue past the rear axle.

In the preferred embodiment, the brake frame is a malleable sheet metal of thickness 0.75 mm. to 1.75 mm. which may be painted or plated. However the brake frame can consist of any other material that can remain rigid under stress, such as rigid plastics, composites, and metals.

Slidable attachment of the frame 11 is shown in FIGS. 1, 2. The frame 11 is channel shaped as formed with flanges 12 extending upwardly from a base portion of the frame which extends beneath the wheel carriage 90. The flanges 12 form sides of the channel shaped frame 11. Flanges 12 which are so bent as to conform to the sides of the wheel carriage 90 which is connected to or incorporated into the foot retaining device 92, a shoe, boot, or foot attachment device. Thus the brake frame 11 slides on the bottom surface of the wheel carriage. The brake frame is sufficiently wider than the wheel carriage to allow it to slide horizontally in a direction perpendicular to the axis of the wheels 98 (FIG. 1, 2). Slots 13 in the flanges 12 of the brake frame accommodate protrusions or retaining screws 50 in wheel carriage 90. Tabs attached to the wheel carriage or protrusions of the wheel carriage may be used in place of retaining screws. The frame can also be slidably attached by tabs of the frame protruding into slots or grooves of the wheel carriage. Furthermore the frame could be attached into the wheel carriage by the frame itself or by ridges of the frame fitting into corresponding grooves of the wheel carriage. Or grooves of the frame may accommodate ridges of the wheel carriage. Thus tabs in slots of either frame or wheel carriage into its counterpart comprises tab in slot attachment, and ridges in grooves of either frame or wheel carriage into its counterpart comprises ridge in groove attachment.

Figure 4:
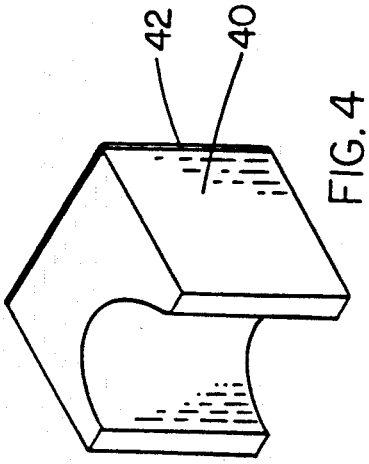
FIG. 4 is a perspective of the pad.
Figure 3:
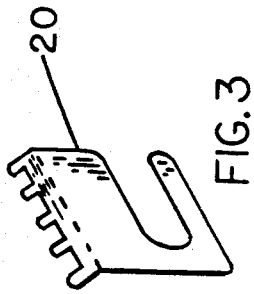
FIG. 3 is a perspective of the cable attachment rack.

Brake pads 40 (FIGS. 1, 2, 4), or pads, are comprised of a friction material which would have a minimal abrasive effect on the wheels. The preferred embodiment in a rubber compound similar to pencil eraser. However polymeric materials or fibrous materials may be suitable for brake pad material.

Brake pad positioning tabs 17 and brake pad positioning tabs 19 provide locating force to position brake pads 40 on brake pad seat 18 during braking Brake pad adhesive 42 provides retention of brake pad when brakes are not in use. The preferred embodiment of brake pad adhesive is a waterproof adhesive bonded onto the seat contact area of the brake pad, protected by a cover until pad mounting. However other fastening methods could position and attach the brake pads such as clamping, bonding with bolts or pins, etc.

Actuating means is provided by cable housing 62 (FIG. 1, 2) attached to cable housing thrust tab 15 and cable 60 attached to a cable hook 64 and forward axle retaining device 94. Cable housing thrust tab 15 transmits forward force of actuator cable housing to brake assembly 10 and allows cable to pass through towards front of the in-line skate. Cable locater and thrust tab can both be stamped and bent from areas of the frame 11. Cable end hook 64 connects actuator cable 60 to one of the attachment positions of cable attachment rack 20. The cable adjustment rack is supported by the wheel axle 94 or other areas on the in-line skate wheel carriage.

Figure 5:
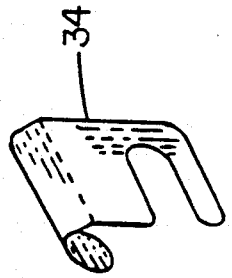
FIG. 5 is a perspective of the retraction anchor.

Retraction band 30 (FIG. 2) is attached to brake frame 11 by crimping tabs 16 around band or other attachment means, and provides means of retraction of the brake frame toward the rear of the skate when braking is not required. The rear end of the retraction band is fastened to the rear most axle 96 or other areas on the in-line skate wheel carriage via retraction band anchor 34 (FIG. 5). The preferred embodiment of the retraction band is 3 mm. to 4 mm. diameter brightly colored "bungie" cord however any elastic or spring type material capable of providing sufficient retractive force could be used. However by using a retraction spring in the hand control and using a rigid actuator cable, sufficient retraction of the brake frame could be achieved without a frame mounted retraction device. Or the skater's hand could supply a retractive force necessary to prevent brake drag.

The hand held control means, or hand control 80 (FIG. 1) of actuator cable 60 and cable housing 62 are extended to reach the waist height of the skater. The lever 82 and lever base 84 thereof is attached to a handle 86 to which is attached a strip of hook and loop fastener 88 which allows hand control 80 of each skate to be combined into one unit thus allowing one hand operation of brakes of both in-line skates. The preferred embodiment of the hand control is a bicycle type cable actuating device commonly found on bicycle handle bars to actuate brakes. The handle 86 may be plastic, wood, metal, or rigid material having a flat area to which is fastened an attachment means which comprises hook and loop fastening device 88 to enable two hand controls to be combined into one unit while skating.

OPERATIONAL DESCRIPTION

Force applied by the skater's hand, pivots lever 82 (FIG. 1) and causes tension of the cable and a corresponding compression of the cable housing 62. As tension increases, the cable housing is drawn towards the front of the skate thus applying a forward force on thrust tab 15 of frame 11 and pads 40, which causes frictional force counter to the rotation of the wheel. As the pad is located at the rear of each wheel, the resulting force from pad friction is upwards onto the wheel carriage. The direction and localization of braking force reduces the strength requirements for the frame and its retainment.

OPERATION

To operate the in-line skate brake, the skater must depress the lever 82 (FIG. 1) towards handle 86 while he or she adjusts his or her position relative to the in-line skates so as to maintain balance. The in-line skater may hold the hand controls in separate hands or combine said devices together such that movement of one hand affects braking of both in-line skates.

Adjustment of lever position with respect to brake pad position is accomplished by placement of cable end hook 64 onto cable attachment rack 20. To compensate for pad wear, the cable end hook is moved forward; to increase freeplay upon pad change, the cable end hook is moved toward the rear.

Worn brake pads are removed by moving pads away from seat 18 by using fingers or any thin pointed rigid object such as a key, knife, nail, stick, etc. Replacement pads are positioned with adhesive side towards the seat and pressed on.

If the in-line skate brake is to be attached to an in-line skate after manufacture or "after market", the brake assembly 10 (FIG. 1) is placed under the in-line skate wheel carriage in the rear most position and retaining screw 50 is located in slot 13 in the forward position of each flange 12 and attached to in-line skate support 90, loosely retaining the frame 11. Cable attachment rack 20 and retraction anchor 34 are inserted under loosened axle retaining devices 94 and 96 respectively; said retaining devices are then tightened. Cable end hook 64 is then attached to rack 20 and adjusted as necessary.

SUMMARY, RAMIFICATIONS AND SCOPE

Accordingly, the reader will see that the in-line skate brake can be incorporated onto or into an in-line skate in manufacturing or "after market". The brake frame distributes braking force uniformly along the in-line skate wheel carriage and placement of the actuator cable and cable housing close to the brake pads reduces undesirable torque upon the brake frame. The close proximity of the cable housing and retraction band to the wheels and brake frame minimally affect tilting of the brake while turning. The mass of the entire braking assembly little affects the process of motation. Furthermore, the in-line skate brake has the additional advantages in that

- it permits controlled deceleration of the skater in instances when traditional deceleration is almost impossible for example steep narrow walkways, crowded areas, tight corners;
- it permits beginning skaters a method of avoiding excessive speed or accidental contact with objects or vehicular traffic;
- it permits unobstructed access to wheels thus not complicating wheel replacement; and
- it permits uncomplicated pad replacement and free play adjustment.

Although the description above contains many specificities, these should not be construed as limiting the scope of the invention but merely as providing illustrations of the presently preferred embodiments of this invention. For example, the frame could be molded plastic, shaped such that it fits into a corresponding shape slot in the in-line skate wheel carriage. Or the brake frame may be shaped as to be retained by another structure such as axle, axle retaining devices, nuts, bolts, bolt heads or other structure of the in-line skate wheel carriage.

Thus the scope of the invention should be determined by the appended claims and their legal equivalents, rather than by the examples given.

I claim:

1. A braking device for an in-line roller skate having a wheel carriage holding at least three wheels in linear alignment; comprising:

a frame slidably attached to the underside of said wheel carriage, said frame holding a plurality of brake pads in linear alignment with one another and in linear alignment with said at least three wheels, an actuating means for sliding said frame with respect to said wheel carriage, a hand held control means for controlling the motion of said actuating means, such that said plurality of brake pads may be brought into frictional engagement with the surface of a plurality of said at least three wheels.

2. The braking device of claim 1 wherein said frame holds said plurality of brake pads within the interstitial spaces between said at least three wheels.

3. The braking device of claim 1 wherein said wheel carriage comprises two substantially linear undersurfaces which are coplanar to one another, and said frame comprises two substantially linear sliding surface resting against said linear undersurfaces such that said frame may slide fore and aft in relation to said at least three wheels.

4. The braking device of claim 1 wherein said frame comprises at least one slot there through and said wheel carriage comprises at least one protrusion extending from said wheel carriage, said protrusion engaging said slot such that said frame is held in sliding attachment to said wheel carriage.

5. The braking device of claim 4 wherein said protrusion comprises at least one retaining screw which engages said slot such that said frame is held in sliding attachment to said wheel carriage.

6. The braking device of claim 1 wherein said actuating means is a cable having an actuator cable and an outer cable housing and said hand held control means is a hand operated lever which moves said actuator cable with respect to said outer cable housing, whereby when said lever moves said actuator cable with respect to said cable housing it acts to slide said frame with respect to said wheel carriage, thus bringing said plurality of brake pads into frictional engagement with the surface of a plurality of said at least three wheels.

7. The braking device of claim 1 wherein said frame comprises a channel shaped frame having a base and two sides, said channel shaped frame being adapted to fit around said wheel carriage such that said frame is held in sliding attachment to said wheel carriage.

8. The braking device of claim 7 wherein said base of said channel member has a plurality of orifices there through to allow said at least three to extend through said orifices such that said frame does not interfere with the rotation of said at least three wheels.

9. The braking device of claim 1 wherein said frame is formed of a thin sheet of metal and said frame closely conforms to said wheel carriage, such that said frame does not extend substantially beyond the dimensions of said wheel carriage so that said braking device does not significantly reduce the ground clearance of said skate.

10. The braking device of claim 1 wherein said hand held control means comprises an attachment means for attaching said control means to a second control means of a second braking device on a second in-line skate, such that both of said control means may be simultaneously operated with one hand for simultaneous operation of both of said braking devices.

11. The braking device of claim 10 wherein said attachment means comprises hook and loop fasteners.

12. A braking device for an in-line roller skate having a wheel carriage holding at least three wheels in linear alignment, comprising:

a channel shaped frame having a base and two sides, said channel shaped frame fitting around said wheel carriage, said base attached to said wheel carriage such that said frame may slide fore and aft in relation to said at least three wheels, said sides having a retaining means for slidably attaching said channel shaped frame to said wheel carriage, said channel shaped frame holding a plurality of brake pads in linear alignment with one another and in linear alignment with said at least three wheels, an actuator cable arranged to slide said channel shaped frame with respect to said wheel carriage, a hand held control lever for operating said actuator cable, whereby said plurality of brake pads may be brought into frictional engagement with the surface of said at least three wheels.

13. The braking device of claim 12 wherein said channel shaped frame holds said plurality of brake pads within the interstitial spaces between said at least three wheels.

14. The braking device of claim 12 wherein said base of said channel shaped frame has a plurality of orifices there through to allow said at least three wheels to extend through said orifices such that said channel shaped frame does not interfere with the rotation of said wheels.

15. The braking device of claim 12 wherein said channel shaped frame is formed of a thin sheet of metal and said channel shaped frame closely conforms to said wheel carriage, such that said channel shaped frame does not extend substantially beyond the dimensions of said wheel carriage so that said braking device does not significantly reduce the ground clearance of said skate.

16. The braking device of claim 12 wherein said device is adapted for installation on a preexisting in-line roller skate.

* * * * *